US011109647B2

(12) United States Patent
Melling

(10) Patent No.: US 11,109,647 B2
(45) Date of Patent: Sep. 7, 2021

(54) CONNECTOR

(71) Applicant: LODE GROUP LIMITED, Maidenhead (GB)

(72) Inventor: Philip Melling, Maidenhead (GB)

(73) Assignee: LODE GROUP LIMITED, Berkshire (GB)

( * ) Notice: Subject to any disclaimer, the term of this patent is extended or adjusted under 35 U.S.C. 154(b) by 0 days.

(21) Appl. No.: 16/641,620

(22) PCT Filed: Aug. 28, 2018

(86) PCT No.: PCT/GB2018/052419
§ 371 (c)(1),
(2) Date: Feb. 24, 2020

(87) PCT Pub. No.: WO2019/043365
PCT Pub. Date: Mar. 7, 2019

(65) Prior Publication Data

US 2021/0153608 A1 May 27, 2021

(30) Foreign Application Priority Data

Aug. 30, 2017 (GB) ..... 1713915

(51) Int. Cl.
*A44B 11/25* (2006.01)
*A44B 11/26* (2006.01)

(52) U.S. Cl.
CPC ..... *A44B 11/2592* (2013.01); *A44B 11/2573* (2013.01); *A44B 11/263* (2013.01)

(58) Field of Classification Search
CPC ..... A44B 11/2592; A44B 11/263; A44B 11/2573; A44B 11/00; A44B 11/02; A44B 11/04; A44B 11/25
USPC ..... 24/614, 615, 616
See application file for complete search history.

(56) References Cited

U.S. PATENT DOCUMENTS 4,171,555 A * 10/1979 Bakker ..... A44B 11/04 24/200
4,282,634 A * 8/1981 Krauss ..... A44B 11/263 24/313
4,662,040 A * 5/1987 Terrell ..... A44B 11/266 24/615

(Continued)

FOREIGN PATENT DOCUMENTS

GB 2475255 A1 5/2011
WO 9820761 A1 5/1998
WO 14109113 A1 7/2014

OTHER PUBLICATIONS

ISR PCTGB201805219 dated Dec. 12, 2018, 3 pages.

*Primary Examiner* — Robert Sandy
(74) *Attorney, Agent, or Firm* — Brooks Kushman P.C.

(57) ABSTRACT

A connector is described having a female part defining a recess, a male part including a section receivable within the recess of the female part, and a lock pin insertable into an opening provided in the female part. The lock pin is engageable with the section of the male part when the male part is located within the recess to retain the male part within the recess. The female part is provided, around a periphery of the opening, with a stabilizing recess. The lock pin includes a feature receivable within the stabilizing recess, engageable with a base of the stabilizing recess to limit the distance by which the lock pin can be inserted into the opening.

10 Claims, 4 Drawing Sheets

(56) References Cited

U.S. PATENT DOCUMENTS

| | | | | |
|---|---|---|---|---|
| 4,800,629 | A * | 1/1989 | Ikeda | A44B 11/266 24/170 |
| 4,811,469 | A * | 3/1989 | Rise | A44B 11/04 24/662 |
| 5,548,879 | A | 8/1996 | Wu | |
| 6,148,486 | A * | 11/2000 | Uehara | A44B 11/10 24/170 |
| 8,863,362 | B2 * | 10/2014 | Kelleghan | A44B 11/266 24/615 |
| 2007/0266746 | A1 * | 11/2007 | Yu | A44B 11/2573 70/69 |
| 2011/0247180 | A1 | 10/2011 | Duong et al. | |

* cited by examiner

CONNECTOR

CROSS-REFERENCE TO RELATED APPLICATIONS

This application is the U.S. national phase of PCT Application No. PCT/GB2018/052419 filed on Aug. 28, 2018, which claims priority to GB Patent Application No. 1713915.5 filed on Aug. 30, 2017, the disclosures of which are incorporated in their entirety by reference herein.

TECHNICAL FIELD

This invention relates to a connector, and in particular to a connector suitable for use in temporarily securing lengths of webbing to one another, or securing opposite end parts of a length of webbing to one another.

BACKGROUND

There are a number of applications in which it is required to be able to secure lengths of webbing, or the opposite ends of a length of webbing, to one another. By way of example, various buckle arrangements are known. One design of connector in common use take the form of two plastics material moulded components, comprising a male component adapted to be inserted in to female component in a snap fit manner. The design of the female component is such that limbs of the male component are accessible when the male component is inserted into the female component, and the application of a lateral load to the exposed limbs can cause deflection thereof to a position in which the male component is no longer retained in position within the female component and so can be removed therefrom.

Where the connector is used to secure, for example, the straps of a backpack or the like, then there may be situations in which the user or another individual may need to quickly release the connector, for example to allow the rapid removal of the backpack. Connectors of the type described hereinbefore are unsuited to such use as it can be difficult, in some circumstances, to gain access to and apply a sufficient load to deflect, the limbs of the male component.

One known form of quick release connector suitable for use in such applications is described in GB2475255 and comprises a male part receivable by a female part, and a lock pin that can be inserted through an opening provided in the female part, cooperating with the male part to retain the male part to the female part. In use, to release the connector the lock pin is simply removed from the female part, after which the male and female parts can separate. The lock pin may have a length of webbing or the like attached thereto to make it easier for the user to apply the required load to the lock pin to withdraw it.

SUMMARY

It has been found that there is a risk with connectors of this type that the lock pin can be inserted into the female part by too great a distance, and that this can result in the connector becoming jammed. Release of the connector may thus be impeded. Obviously, this is undesirable. Furthermore, the shape of the lock pin is such that, when a load is applied to the webbing straps or the like attached thereto to withdraw the lock pin, the lock pin tends to tilt within the opening provided in the female part, again with the result that it may become jammed, or that a greater than desired load must be applied to remove the lock pin.

It is an object of the invention to provide a connector suitable for use in such applications and in which at least some of the disadvantages associated with known arrangements are overcome or are of reduced effect.

According to one aspect of the invention there is provided a connector comprising a female part defining a recess, a male part including a section receivable within the recess of the female part, and a lock pin insertable into an opening provided in the female part, the lock pin being engageable with the said section of the male part when the male part is located within the recess to retain the male part within the recess, wherein the female part is provided, around a periphery of the opening, with a stabilizing recess, and the lock pin includes a feature receivable within the stabilizing recess, engageable with a base of the stabilizing recess to limit the distance by which the lock pin can be inserted into the opening.

By restricting the distance by which the lock pin can be inserted into the opening provided in the female part, the risk of over-insertion of the lock pin and associated risk of the connector becoming jammed is reduced.

Preferably, the stabilizing recess is of annular form, and the feature takes the form of an annular step. The outer diameter of the stabilizing recess is preferably only slightly larger than the outer diameter of the annular step. As a consequence lateral movement of the lock pin is resisted. Tilting of the lock pin during release is thus resisted and the lock pin is better supported and guided. The risk of jamming is thus further reduced.

Preferably the lock pin is resiliently attachable to the said section of the male part. By way of example, it may be provided with a pip resiliently receivable, in use, by resilient deflection of the said section, within a recess provided in the said section. The resilient attachment preferably occurs only when the lock pin is fully inserted into the opening. As a consequence, relative movement between the male part, the female part and the lock pin when the connector is assembled is reduced, and so wear between the various parts of the connector is reduced.

The pip is preferably of asymmetric form, for example having a first radius of curvature at its lower edge and a second, preferably smaller, radius of curvature at its upper edge. As a consequence, insertion of the locking pin may be relatively straightforward, removal thereof requiring the application of a larger force.

One of the male and female parts, preferably the male part, preferably has formations allowing the attachment of webbing thereto in an adjustable fashion. The formations preferably comprise an opening or recess across which a bar extends. In use, the webbing is conveniently passed into the recess or opening from the underside thereof, the webbing being wound over and around the bar and exiting the recess or opening from the underside thereof. The bar is preferably positioned at or adjacent the front side of the said part. The bar is preferably of tapering cross-sectional shape, being widest at its lower face. An internal wall of the recess or opening that, in use, engages the webbing, is preferably provided with projections. Cooperation between the webbing, in use, and the projections may further serve to resist movement of the webbing relative to the said part. The projections preferably take the form of ribs, for example of tapering form.

The lock pin preferably has an attachment section including a bar to which a strap can be attached. Preferably, the attachment section has a shape and size such that the bar is offset from an axis of the lock pin by only a relatively small distance, if at all. Preferably, an angle between the axis of the lock pin and a notional line interconnecting the bar and the axis of the lock pin at the level of the outer surface of the female part is less than about 55 degrees. Preferably, it is in the region of 45 degrees. It will be appreciated that by designing the lock pin, and the attachment section thereof, in this manner, the application of a load to the lock pin via a strap or the like attached to the bar applies a reduced torque to the lock pin tending to cause tilting thereof. The risk of the lock pin becoming jammed is thus, again, reduced.

In contrast, in the known quick release connector described hereinbefore, an angle in the region of 60 degrees is subtended, in part due to the bar thereof being spaced from the axis of the lock pin by an increased distance.

The bar may, if desired, be aligned with the axis of the lock pin, thus an angle of zero degrees may be subtended in some arrangements.

According to another aspect of the invention there is provided a connector comprising a female part defining a recess, a male part including a section receivable within the recess of the female part, and a lock pin insertable into an opening provided in the female part, the lock pin being engageable with the said section of the male part when the male part is located within the recess to retain the male part within the recess, wherein lock pin has an attachment section including a bar to which a strap can be attached, the attachment section having a shape and size such that the bar is offset from an axis of the lock pin by only a relatively small distance.

Preferably, an angle between the axis of the lock pin and a notional line interconnecting the bar and the axis of the lock pin at the level of the outer surface of the female part is less than about 55 degrees. Preferably, it is in the region of 45 degrees, say between 42 and 48 degrees. As mentioned hereinbefore, it will be appreciated that by designing the lock pin, and the attachment section thereof, in this manner, the application of a load to the lock pin via a strap or the like attached to the bar applies a reduced torque to the lock pin tending to cause tilting thereof. The risk of the lock pin becoming jammed is thus, again, reduced.

BRIEF DESCRIPTION OF THE DRAWINGS

The invention will further be described, by way of example, with reference to the accompanying drawings, in which.

DETAILED DESCRIPTION

Figure 1:
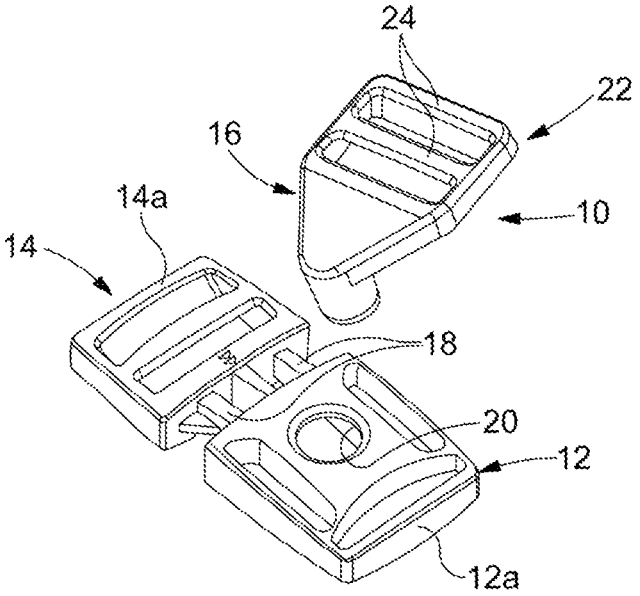
FIG. 1 is a view illustrating a known quick release connector.

Referring firstly to FIG. 1, a quick release connector 10 is illustrated which comprises a female part 12, a male part 14 and a lock pin 16. All three components are conveniently of moulded plastics material form. The female part 12 is hollow, defining a recess into which projecting fingers 18 of a retaining section of the male part 14 can be received. The projecting fingers 18 defining an opening which, when the retaining section is fully inserted into the recess of the female part 12, aligns with an opening 20 provided in the female part 12. With the male and female parts 12, 14 in this position, part of the lock pin 16 can be inserted through the opening 20 and into the opening defined by the fingers 18 of the male part 14, the lock pin 16 serving to secure the male and female parts 12, 14 to one another. The lock pin 16 is shaped to define an attachment part 22 including bars 24 to which straps or the like (not shown) can be attached, the straps serving as grab handles which, when the connector 10 is to be released, may be grabbed and pulled to apply a load to the lock pin 16 to withdraw the lock pin 16 from the male and female parts 12, 14, and so allow separation of the male and female parts 12, 14 to release the connector 10.

The male and female parts 12, 14 are each shaped to define attachment bars 12*a*, 14*a* to which respective lengths of webbing or the like may be attached, such that the connector 10 can be used to connect the lengths of webbing to one another. Alternatively, the connector 10 may be used to connect the ends of a single length of webbing to one another to form a loop, if desired.

Whilst the connector 10 may be used in a range of applications, one use to which is may be put is in securing the straps of a back pack or equipment to be carried by a user, release of the connector allowing the rapid removal of the back pack or equipment.

Figure 2:
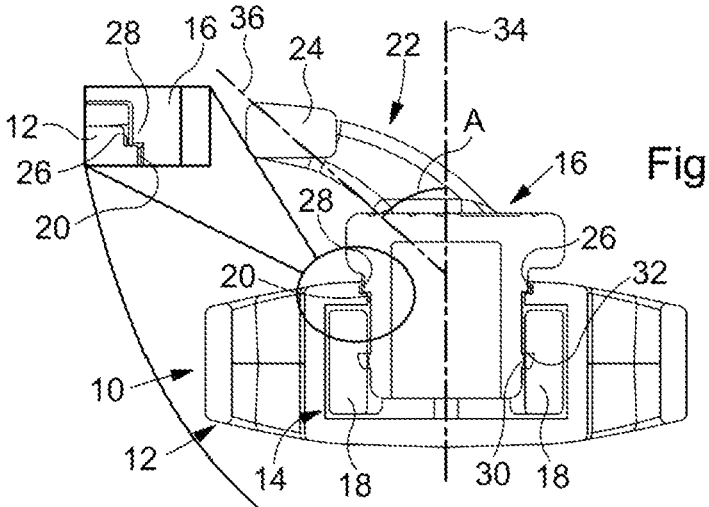
FIG. 2 is a sectional view illustrating part of a quick release connector in accordance with an embodiment of the invention.
Figure 2A:
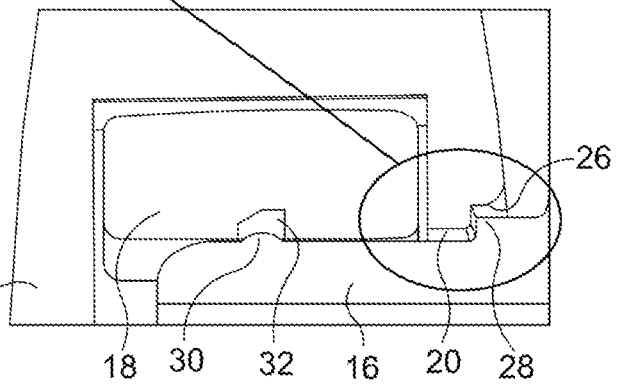
FIG. 2*a* is a view showing part of the arrangement of FIG. 2 to an enlarged scale.

FIGS. 2 and 2*a* show an arrangement that is similar to FIG. 1. For the most part, only the significant differences between the arrangement of FIG. 1 and that of FIGS. 2 and 2*a* are described herein in detail.

As shown in FIGS. 2 and 2*a*, in accordance with an embodiment of the invention, the opening 20 formed in the female part 12 is shaped to define, adjacent the surface of the female part 12, an annular stabilizing recess 26. The stabilizing recess 26 is of relatively shallow form, extending through only about half of the wall thickness of the adjacent part of the female part 12. In other words, the opening 20 is of stepped form. The lock pin 16 is provided with a stabilizing feature in the form of an annular step 28. The outer diameter of the annular step 28 is slightly smaller than the maximum diameter of the stabilizing recess 26 with the result that the annular step 28 can be received within the stabilizing recess 26, the engagement of the annular step 28 with the base of the stabilizing recess 26 serving to limit the distance by which the lock pin 16 can be inserted into the female part 12, and the cooperation between the outer peripheral edges of the annular step 28 and the walls of the stabilizing recess 26 serving to restrict lateral movement of the lock pin 26 relative to the female part 12.

The lock pin 16 includes an annular outwardly projecting rib or pip 30 which is received within a groove 32 formed in or defined by the fingers 18 when the lock pin 16 is fully inserted, the annular step 28 abutting the base of the stabilizing recess 26.

The attachment part 22 is integrally formed with the remainder of the lock pin 16 and includes an attachment bar 24 to which a webbing strap or the like forming a grab handle may be attached. The design of the attachment part 22 is such that the bar 24 is spaced from an axis 34 of the lock pin 16 by only a relatively small distance so that a load applied to the lock pin 16 by pulling the strap or the like attached thereto away from the female part 12 applies only a relatively small torque in a direction urging the lock pin 16 to tilt relative to the female part 12. Consequently, as the torque is low, the risk of the lock pin 16 becoming jammed when it is desired to release the connector 10 is reduced. As illustrated, the attachment part 22 is of relatively small length, and is shaped so as to be angled away from the female part 12 (when the connector 10 is in its assembled, in use, condition) such that an angle A subtended between the axis 34 and a notional line 36 interconnecting the bar 24 with the axis 34 at the level of the surface of the female part 12 is less than 55 degrees. In the arrangement shown it is approximately, 45 degrees, falling within a range of, say, 42 to 48 degrees.

To aid insertion of the lock pin 16, the end thereof is conveniently of radiused form, and the corresponding surfaces of the fingers 18 are preferably similarly shaped, as shown. Although not illustrated, the fingers 18 and surfaces of the female part 12 defining the recess are conveniently also of radiused form to aid insertion of the fingers 18 into the recess. Incorrect assembly of the connector 10 is thus unlikely, and damage which may occur as a result of such incorrect assembly is reduced.

In use, the connector 10 is used in substantially the same manner as the known quick release connector, the connector 10 being assembled by inserting the fingers 18 of the male part 14 into the recess of the female part 12, and subsequently inserting the lock pin 16 into the opening 20 provided in the female part 12 to secure the male and female parts 12, 14 to one another. When in this condition, the pip 30 sits within the recess 32 defined by the fingers 18, and serves to retain the lock pin 16 in position, limited separation of the fingers 18 being required, as permitted by their inherent resilience, to allow the pip 30 to be released from the recess 32, and hence for removal of the lock pin 16 to occur. The step 28 sits within the stabilizing recess 26, preventing over insertion of the lock pin 16 and resisting lateral movement of the lock pin 16 relative to the female part 12. It will be appreciated that the combination of the fact that the pip 30 is located within the recess 32 with the annular step 28 being located within the recess 26 holds the male and female parts 12, 14 and the lock pin 16 against significant relative movement, there being little, if any, play between the parts of the connector 10 when assembled, and so wear between the parts of the connector 10 is reduced. The connector 10 remains securely closed and so securely attaches the webbing materials attached to the male and female parts 12, 14 to one another in this condition.

When the connector 10 is to be released, the webbing strap attached to the bar 24 is pulled, applying a load to the lock pin 16 to cause it to be retracted from the opening 20, and so allowing the male and female parts 12, 14 to separate. The design of the attachment part 22 ensures that the torque urging the lock pin 16 for tilting movement is low, and so removal of the lock pin 16 is not hindered.

It will be appreciated that the arrangement described hereinbefore is advantageous in that the risk of it becoming jammed is reduced, and instead safe, effective operation thereof is ensured or more likely to occur. Over insertion of the lock pin 16 is avoided, tilting of the lock pin is resisted and movement and wear between the component parts of the connector is reduced.

Figure 3:
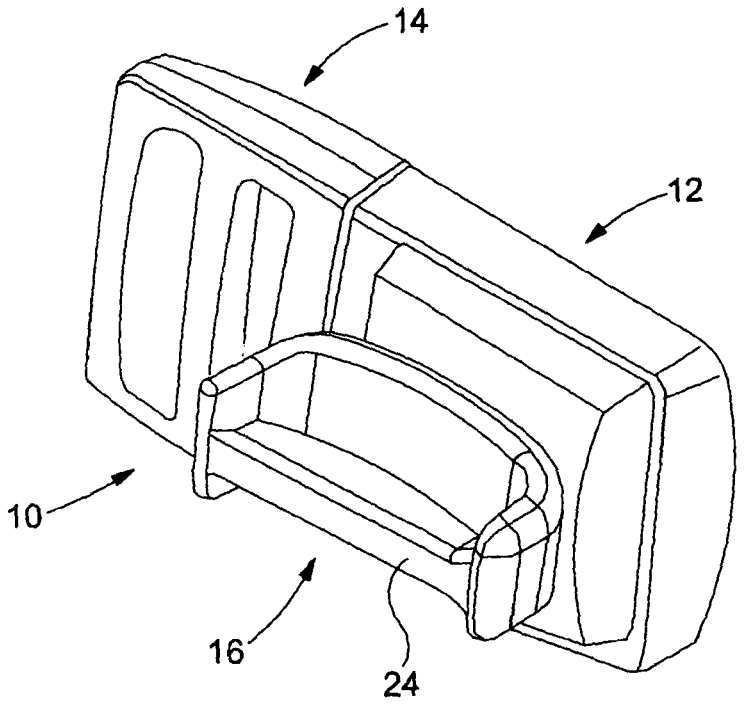
FIG. 3 is a side view illustrating a quick release connector in accordance with another embodiment of the invention.
Figure 4:
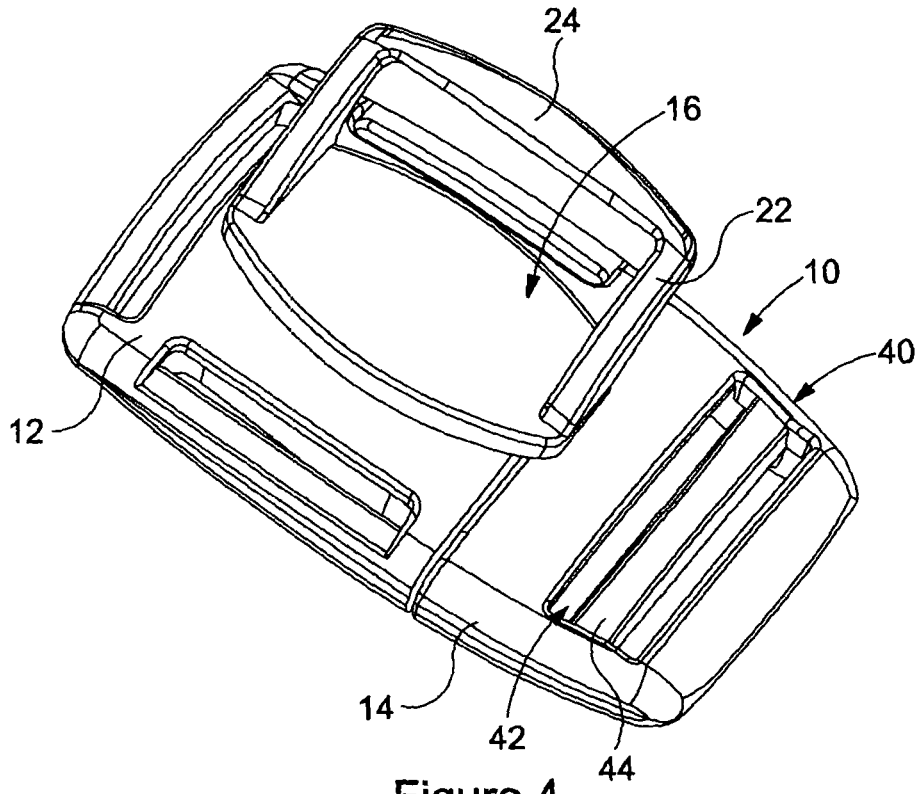
FIGS. 4 to 9 are views illustrating another embodiment of the invention including modifications to the arrangements shown in FIGS. 2 and 3.
Figure 5:
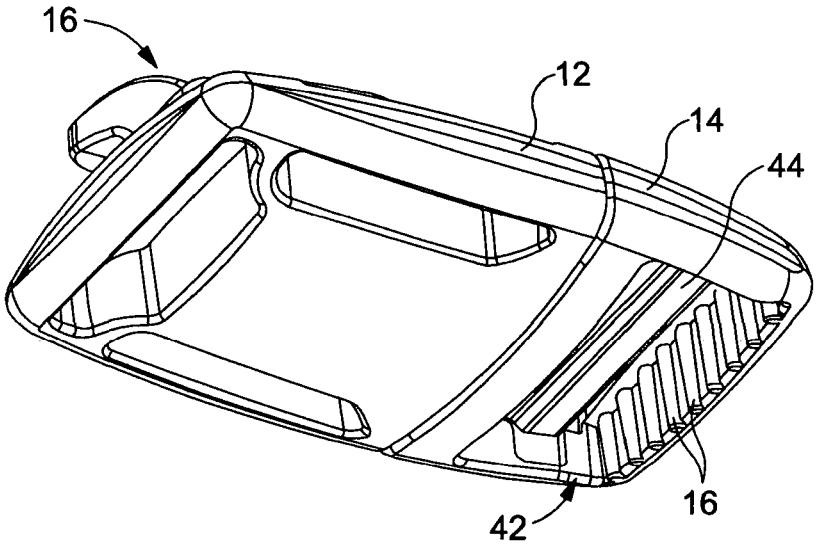
Figure 6:
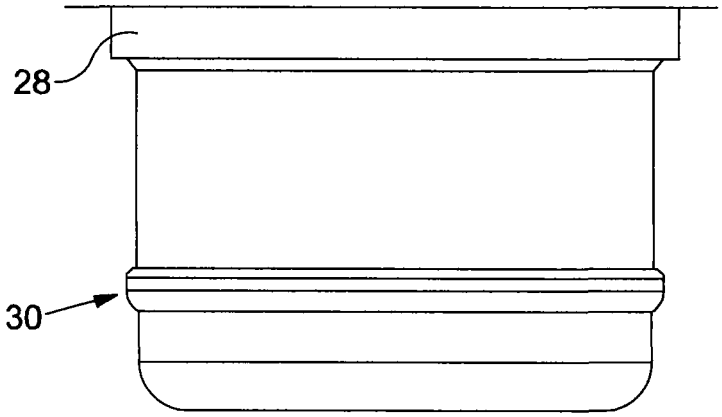
Figure 7:
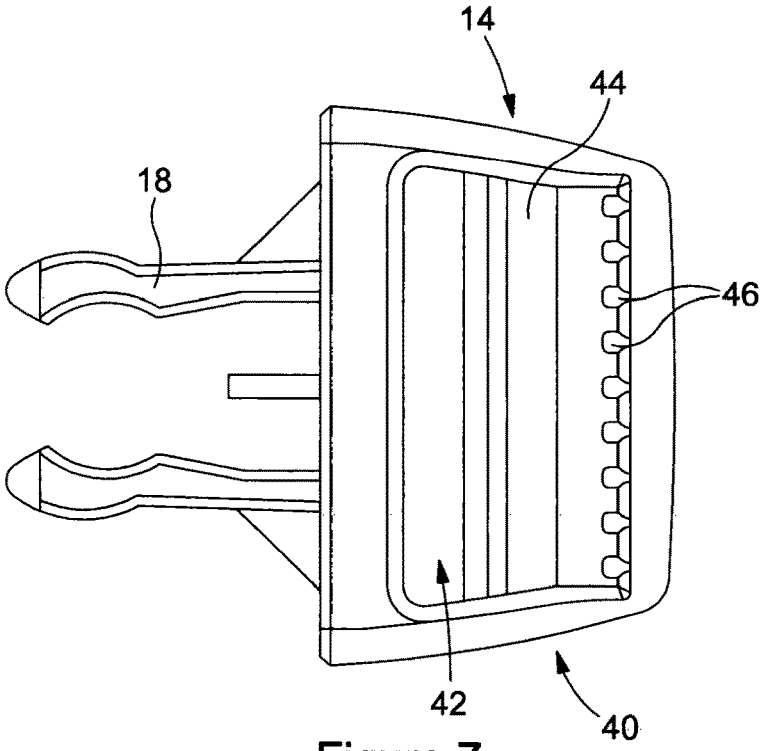
Figure 8:
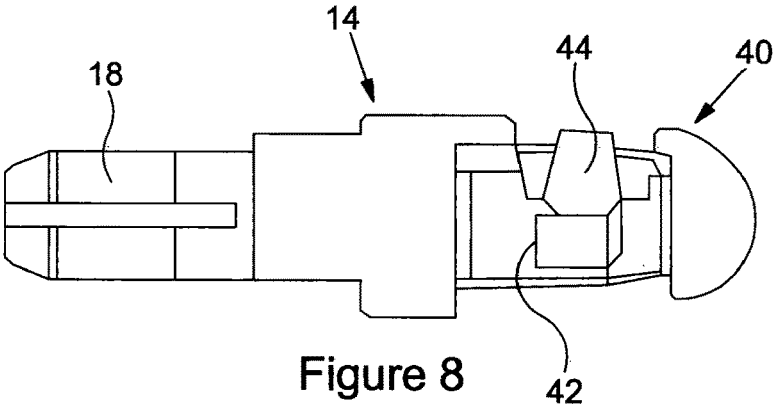
Figure 9:
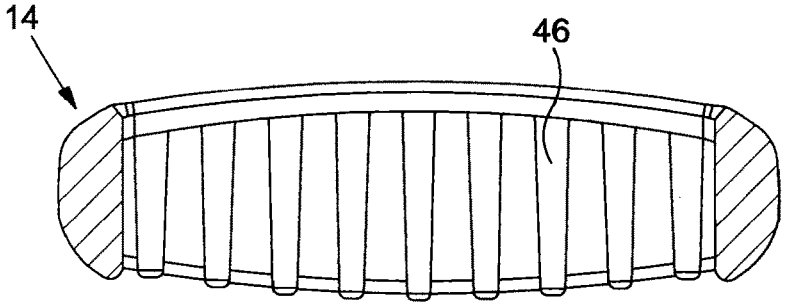

FIG. 3 illustrates a modification in which the shape of the attachment part 22 is further modified to result in the bar 24 being aligned with the axis 34. The risk of the connector 10 becoming jammed upon attempted release is thus further reduced.

FIGS. 4 to 9 illustrate an embodiment similar to those of FIGS. 2 and 3, and only the differences therebetween are described herein in detail. Like reference numerals are used to denote like parts.

A first distinction between the arrangement of FIGS. 4 to 9 and those of FIGS. 2 and 3 relates to the form of the pip 30. In the arrangement of FIGS. 2 and 3 it is of diameter in the region of, for example, 11.3 mm and has a constant radius of curvature of around 0.68 mm. In the arrangement of FIGS. 4 to 9, it is of increased diameter, for example being of diameter in the region of 11.5 mm, and is of asymmetric form. Specifically, the radius of curvature of a lower edge of the pip 30 differs from that of the upper edge of the pip 30. The lower edge of the pip 30 preferably has a greater radius of curvature than the upper edge. By way of example, the lower edge may have a radius of curvature in the region of 0.5 mm, and the upper edge may have a radius of curvature in the region of 0.2 mm. As a consequence, insertion of the locking pin is relative straightforward, but an increased force needs to be applied to remove the locking pin and release the clip.

A second distinction relates to the attachment of the webbing to one of the parts of the clip, in this case to the male part 14. The manner in which the webbing is attached is designed to allow adjustment of the webbing but to resist relative movement between the webbing and the male part 14 when the clip is in use and the webbing is tight. This is achieved using attachment features 40 in the form of a recess or opening 42 across which a bar 44 extends. The bar 44 is located at or adjacent the front face of the male part 14, and is of tapering cross sectional shape, being widest at its face facing towards the rear or underside of the clip. In use, webbing in introduced into the opening 42 from the underside thereof, is wound around and over the bar 44, exiting the opening 42 from the underside so that the exiting length of the webbing is trapped between the incoming part of the webbing and the underside of part of the male part 14.

A part of the opening 42 is provided with features in the form of ribs 46 which bear against the adjacent part of the webbing, in use, serving at teeth digging into the webbing when the webbing is tight, and so further aiding in resisting relative movement between the webbing and the male part 14. The ribs 46 are conveniently of tapering form, as shown.

Other than as described hereinbefore, the arrangement of FIGS. 4 to 9 is substantially of the form shown in FIG. 2, and in use is operated in substantially the manner described hereinbefore.

Whilst specific embodiments of the invention are described hereinbefore, it will be appreciated that a wide range of modifications and alterations may be made thereto without departing from the scope of the invention as defined by the appended claims.

The invention claimed is:

1. A connector comprising a female part defining a recess, a male part including a section receivable within the recess of the female part, and a lock pin insertable into an opening provided in the female part, the lock pin being engageable with the said section of the male part when the male part is located within the recess to retain the male part within the recess, wherein the female part is provided, around a periphery of the opening, with a stabilizing recess, and the lock pin includes a feature receivable within the stabilizing recess, engageable with a base of the stabilizing recess to limit the distance by which the lock pin can be inserted into the opening, wherein the lock pin is resiliently attachable to the said section of the male part, the lock pin being provided with a pip resiliently receivable, in use, by resilient deflection of the said section, within a recess provided in said section.

2. The connector according to claim 1, wherein the stabilizing recess is of annular form, and the feature takes the form of an annular step.

3. The connector according to claim 2, wherein the outer diameter of the stabilizing recess is only slightly larger than the outer diameter of the annular step.

4. The connector according to claim 1, wherein the resilient attachment occurs only when the lock pin is fully inserted into the opening.

5. The connector according to claim 1, wherein the pip is of asymmetric form.

6. The connector according to claim 1, wherein the lock pin has an attachment section including a bar to which a strap can be attached, wherein the attachment section has a shape and size such that the bar is offset from an axis of the lock pin by a distance sufficiently small for reducing torque in a direction urging the lock pin to tilt relative to the female part.

7. The connector according to claim 6, wherein an angle between the axis of the lock pin and a notional line interconnecting the bar and the axis of the lock pin at the level of the outer surface of the female part is less than 55 degrees.

8. The connector according to claim 1, and including an adjustable connection between at least one of the male and female parts and an associated length of webbing, the adjustable connection comprising an opening across which a bar extends, the bar being located at or adjacent a front face of the said part.

9. The connector according to claim 8, and further comprising engagement features provided within the opening and cooperable with the webbing, in use, the engagement features comprising ribs.

10. A connector comprising;

a female part having a body defining an elongate recess with a transverse opening extending into the recess, a male part including a section having a pair of spaced apart flexible projecting fingers receivable within the recess of the female part to latch the male and female parts together when inserted, and a lock pin removably insertable into the opening provided in the female part, the lock pin being oriented between the pair of spaced apart flexible projecting fingers when the male part is located within the recess to retain the male part within the recess, wherein the female part is provided, around a periphery of the opening, with a stabilizing recess, and the lock pin includes a feature receivable within the stabilizing recess, engageable with a base of the stabilizing recess to limit the distance by which the lock pin can be inserted into the opening, wherein the lock pin has an annularly projecting rib resiliently receivable within a recess provided in the pair of spaced apart flexible projecting fingers.

* * * * *